US009816159B2

(12) United States Patent
Tiwary et al.

(10) Patent No.: US 9,816,159 B2
(45) Date of Patent: Nov. 14, 2017

(54) NICKEL-ALUMINIUM-ZIRCONIUM ALLOYS

(75) Inventors: Chandrasekhar Tiwary, Bangalore (IN); Sanjay Kashyap, Bangalore (IN); Olu Emmanuel Femi, Bangalore (IN); Dipankar Banerjee, Bangalore (IN); Kamanio Chattopadhyay, Bangalore (IN)

(73) Assignee: INDIAN INSTITUTE OF SCIENCE, Bangalore (IN)

( * ) Notice: Subject to any disclaimer, the term of this patent is extended or adjusted under 35 U.S.C. 154(b) by 64 days.

(21) Appl. No.: 14/383,082

(22) PCT Filed: Jun. 4, 2012

(86) PCT No.: PCT/IN2012/000387

§ 371 (c)(1),
(2), (4) Date: May 20, 2015

(87) PCT Pub. No.: WO2013/132508

PCT Pub. Date: Sep. 12, 2013

(65) Prior Publication Data

US 2015/0292062 A1 Oct. 15, 2015

(30) Foreign Application Priority Data

Mar. 9, 2012 (IN) ..... 900/CHE/2012

(51) Int. Cl.

| | |
|---|---|
| ***C22C 19/03*** | (2006.01) |
| ***C22C 19/05*** | (2006.01) |
| ***C22C 1/02*** | (2006.01) |
| ***C22C 19/00*** | (2006.01) |
| *C22C 1/04* | (2006.01) |

(52) U.S. Cl.

CPC ..... *C22C 19/03* (2013.01); *C22C 1/023* (2013.01); *C22C 19/007* (2013.01); *C22C 19/05* (2013.01); *C22C 1/0433* (2013.01); *C22C 1/0491* (2013.01)

(58) Field of Classification Search

CPC ..... C22C 19/03; C22C 19/007

See application file for complete search history.

(56) References Cited

U.S. PATENT DOCUMENTS

| | | | |
|---|---|---|---|
| 3,046,108 | A | 7/1962 | Eiselstein |
| 3,904,402 | A | 9/1975 | Smashey |
| 4,111,723 | A | 9/1978 | Lemkey |
| 4,731,221 | A | 3/1988 | Liu |
| 5,104,614 | A | 4/1992 | Ducrocq et al. |
| 5,336,340 | A | 8/1994 | Cahn |
| 5,366,695 | A | 11/1994 | Erickson |
| 6,190,467 | B1 | 2/2001 | Jackson et al. |
| 6,482,355 | B1 | 11/2002 | Santella et al. |
| 6,966,956 | B2 | 11/2005 | Koizumi et al. |
| 2008/0008618 | A1 | 1/2008 | Sato et al. |
| 2010/0143182 | A1 | 6/2010 | Sato et al. |

FOREIGN PATENT DOCUMENTS

| | | |
|---|---|---|
| CN | 101148729 A | 3/2008 |
| EP | 1 767 667 B1 | 9/2010 |

OTHER PUBLICATIONS

Decker et al., "The Mechanism of Beneficial Effects of Boron and Zirconium on Creep-Rupture Properties of a Complex Heat-Resistant Alloy," Report 57 to the National Advisory Committee for Aeronautics, Project 1478-11, Oct. 1957.*

Jayanth et al., "Phase Equilibria in the Ni-Rich Region of the Ni—Al—Zr system," MRS Proceedings 19, pp. 395-398, Dec. 1982.*

Kim et al., "Phase transformation and microstructure of NiAl/Ni3Al alloys containing Ti," Scripta Materialia 48(4), pp. 443-448, Feb. 2003.*

Extended European Search Report, dated Dec. 10, 2015, for European Application No. 12870721.3-1362/2823074, 9 pages.

Inoue et al., "Formation of non-equilibrium b.c.c. phase with high tensile strength in Ni—Al—Zr system by rapid solidification," *Materials Science and Engineering A181-A182*:1072-1075, 1994.

International Search Report, dated Sep. 19, 2012, for International Application No. PCT/IN2012/000387, 4 pages.

Miura et al., "Reinvestigation of Ni-Solid Solution/Liquid Equilibria in Ni—Al Binary and Ni—Al—Zr Ternary Systems," *Journal of Phase Equilibria 22*(4):457-462, 2001.

Tsau et al., "Microstructures and mechanical properties of Ni—Al—Fe—X intermetallics based on Ni-25AL-27.5Fe alloy," *Materials Chemistry and Physics 65*:136-143, 2000.

Written Opinion of the International Searching Authority, dated Sep. 19, 2012, for International Application No. PCT/IN2012/000387, 4 pages.

* cited by examiner

*Primary Examiner* — Jessee Roe

(74) *Attorney, Agent, or Firm* — Seed IP Law Group LLP

(57) ABSTRACT

The present subject matter describes Ni—Al—Zr alloys, which include Ni as the major component, with the additions of 9-20% Al and 4-14% Zr by atomic percentage. In one embodiment, the present subject matter describes a group of alloy compositions in a Nickel-Aluminum-Zirconium (Ni—Al—Zr) system corresponding to a concentration range of about 9-20% Al and about 4-14% Zr by atomic percentages, and the balance being Ni. In other embodiment, the present subject matter includes at least one eutectic constituent including at least two of the intermetallic compounds or phases $Ni_3Al$, NiAl, $Ni_5Zr$, $Ni_7Zr_2$ and derivatives that are realized within the aforementioned composition group.

12 Claims, 17 Drawing Sheets

(a)

200

Alloy A

200

Alloy B

200

Alloy C

300

300

300

700

800

900

1000

1100

1110

1200

1210

NICKEL-ALUMINIUM-ZIRCONIUM ALLOYS

TECHNICAL FIELD

The present subject matter, in general, relates to alloys for high temperature applications and, in particular, relates to nickel-base eutectic alloys.

BACKGROUND

Nickel (Ni) based superalloys are used as materials in applications that are exposed to high temperatures for long periods. Examples of such applications are gas turbine engines, where a reasonable strength at high temperatures, stability of microstructure, oxidation resistance, and low density of the materials are important considerations. Such Ni-based superalloys can be used in a wrought form, or consolidated form from powder, or in a cast form.

In an example, wrought alloys include IN718 described in U.S. Pat. No. 3,046,108. The nominal composition of the alloy described in this invention is Ni-17% Fe-19% Cr-3.15Mo-5.15% (Nb+Ta)-5% Al, and it has a density of 8.19 gm/cm$^3$. This alloy retains its yield strength, which is 950 Mega Pascal (MPa) at about 650° C. in large sections. Further, the alloy is strengthened by a fine distribution of intermetallic precipitates based on the intermetallic compound, $Ni_3Al$, designated as γ' and an intermetallic compound based on $Ni_3Nb$ in a matrix containing Ni and Fe (designated γ"). Another commonly used wrought alloy used in disc and blade applications of gas turbine engines, UDIMET 720 with a nominal composition Ni-16% Cr-14.75% Co-3% Mo-1.25% W-5% Ti-2.5% Al-0.01% C-0.0275% Zr-0.15% B and a density of 8.08 gm/cm$^3$ by weight, was introduced in 1986 (UDIMET is a Registered Trade Mark of Special Metals Corporation), and has a slightly improved strength at 700° C.

An alternative approach for large high temperature applications is based on consolidation of alloy powders. The usage of powder permits higher alloying levels without attendant segregation of elements in the product. For example, the U.S. Pat. No. 5,104,614 discloses the composition of alloy designated as N18 which retains high temperature yield strength to about 1000 MPa at 750° C. The use of powder permits higher alloying levels without attendant segregation of elements in the product. The nominal composition of N18 is Ni-11.5% Cr-15.7% Co-6.5% Mo-0.6W-4.5% Al-4.35% Ti-0.45Hf by weight and this alloy is strengthened by a fine dispersion of the intermetallic compound γ' in a matrix of γ.

Further, in certain high temperature applications, cast alloys are used. Such alloys may be in the equiaxed, directionally solidified or single crystal form. For example, U.S. Pat. No. 5,366,695 describes a single crystal composition, known commercially as CMSX10, which is nominally Ni-5.7% Al-0.2% Ti-2% Cr-3% Co-5% W-8% Ta-6% Re-0.4% Mo-0.33% Hf by weight and has a density of 9.05 gm/cm$^3$. This alloy is also precipitation-strengthened by high volume fractions of γ' and retains high temperature yield strength of about 950 MPa to temperatures greater than 850° C. The process used to manufacture a material using the cast alloys limits its application to manufacturing of products having thin sections and limited dimensions. The materials represented by this class of alloys are used as turbine aerofoils in gas turbines. Further examples of such single crystal alloys strengthened by high volume fractions of γ' can be found in U.S. Pat. No. 6,966,956 and US Patent Publication No US2010/0143182, which teach improvement of the long term stability and oxidation resistance of such alloys.

Alloys as described above are derived from the beneficial effects of a fine dispersion of an intermetallic compound $Ni_3Al$ in a disordered matrix strengthened by various elements that contribute to solid solution strengthening and also limit atomic mobility at high temperatures. Such γ'-strengthened cast alloy compositions strengthened cast alloy compositions can be reinforced by unidirectionally aligned, coarsely spaced, carbide fibers through directional solidification of eutectic compositions, as described, for example, in U.S. Pat. No. 3,904,402. These materials retain strength levels of about 950 MPa to nearly 870° C. Similarly, U.S. Pat. No. 4,111,723 discloses another example directionally solidified eutectic alloy with molybdenum fibers. Due to a unidirectional alignment of fibers, the properties of these directionally solidified eutectic alloys are anisotropic, with poor transverse properties. Further, the process of manufacture of such eutectic alloys requires low solidification rates, which may lead to long manufacturing cycles.

Ni based alloys have emerged as materials of choice for high temperature applications in the range 600° C. to 1110° C. based on the properties of the disordered matrix γ phase and the intermetallic compound γ' of the Ni based alloys. However, the high temperature properties of such Ni based alloys are ultimately limited by presence of the disordered matrix γ phase. U.S. Pat. No. 5,336,340 discloses a different metallurgical approach consisting of a combination of the intermetallic compound $Ni_2AlTi$ (β') and $Ni_3Al$ (γ') dispersed in a matrix of the intermetallic compound NiAl (β) in the Ni—Ti—Al system. Such alloys are shown to possess extremely high strength, ranging from 1000 MPa to 1455 MPa at room temperature and retain high strength up to 1200 MPa at 700° C. However, the alloys have only been tested in compression and no evidence of tensile ductility, which is important for engineering applications, has been provided.

It is known that finer scale structures arising from eutectic or peritectic reactions in iron, magnesium, titanium and aluminium alloys with disordered matrix phases and intermetallic compounds offer improved combinations of compressive strength and ductility. However, it is also well known in the prior art that intermetallic compounds offer improved high temperature properties but suffer from the problems of ambient temperature ductility.

The present invention exploits the interaction between eutectic and peritectic reactions that form intermetallic compounds, including γ' in certain binary systems with Ni as the base, to form fine scale structures constituted entirely of different combinations of intermetallic compounds in ternary and more complex systems.

SUMMARY

This summary is provided to introduce a distinctive metallurgical approach and concepts related to combinations of multiple intermetallic phases in different fine-scale eutectic combinations in the nickel-aluminium-zirconium system with high temperature strength, oxidation resistance, microstructural stability and relatively low density. The concepts are further described below in the detailed description. This summary is not intended to identify essential features of the claimed subject matter nor is it intended for determining or limiting the scope of the claimed subject matter.

In one embodiment, the present subject matter describes a group of alloy compositions in a Nickel-Aluminium-Zirconium (Ni—Al—Zr) system corresponding to a concentration range of about 9-20% Al and about 4-14% Zr by atomic percentages, and the balance being Ni. In another embodiment, the present subject matter includes at least one eutectic constituent including at least two, of the intermetallic compounds or phases $Ni_3Al$, NiAl, $Ni_5Zr$, $Ni_7Zr_2$ and their derivatives that are realized within the aforementioned composition group.

In another embodiment, the present subject matter includes the aforementioned eutectic constituents combined with various primary solidification phases based on the aforementioned intermetallic compounds that are realized within the afore-mentioned group of compositions. The alloys according to present subject matter exhibit high compressive strengths ranging from about 0.85 Giga Pascal (GPa) to about 2.2 GPa, compressive ductilities ranging from about 3 to 9%, with similar tensile strength, and ductility up to 4% in the cast condition. Further, the alloys retain strength in the range 0.85 GPa to 1.9 GPa up to temperatures of 700° C.

In yet another embodiment, these alloys exhibit oxidation resistance and microstructural stability up to temperatures of about 1100° C.

BRIEF DESCRIPTION OF DRAWINGS

The detailed description is provided with reference to the accompanying figures. In the figures, the left-most digit(s) of a reference number identifies the figure in which the reference number first appears. The same numbers are used throughout the drawings to reference like features and components.

DETAILED DESCRIPTION

The present subject matter utilizes an interaction between eutectic and peritectic reactions that form intermetallic compounds, including γ' in certain binary systems with Ni as the base, to form fine scale structures constituted of different combinations of intermetallic compounds in ternary and further complex systems. The alloys described herein exhibit superior strength over conventional Ni base superalloys at temperatures up to 700° C. Such alloys also have high oxidation resistance and micro-structural stability at elevated temperatures up to about 1100° C. Further, the alloys possess reasonable tensile ductility at ambient temperature In addition, the alloys exhibit a comparatively low density ranging from 7.3-7.9 gm/cm$^3$. Furthermore, the aforementioned properties of the alloys have been realized with alloying additions to Ni, such as Al and Zr that have a relatively low cost.

Figure 1:
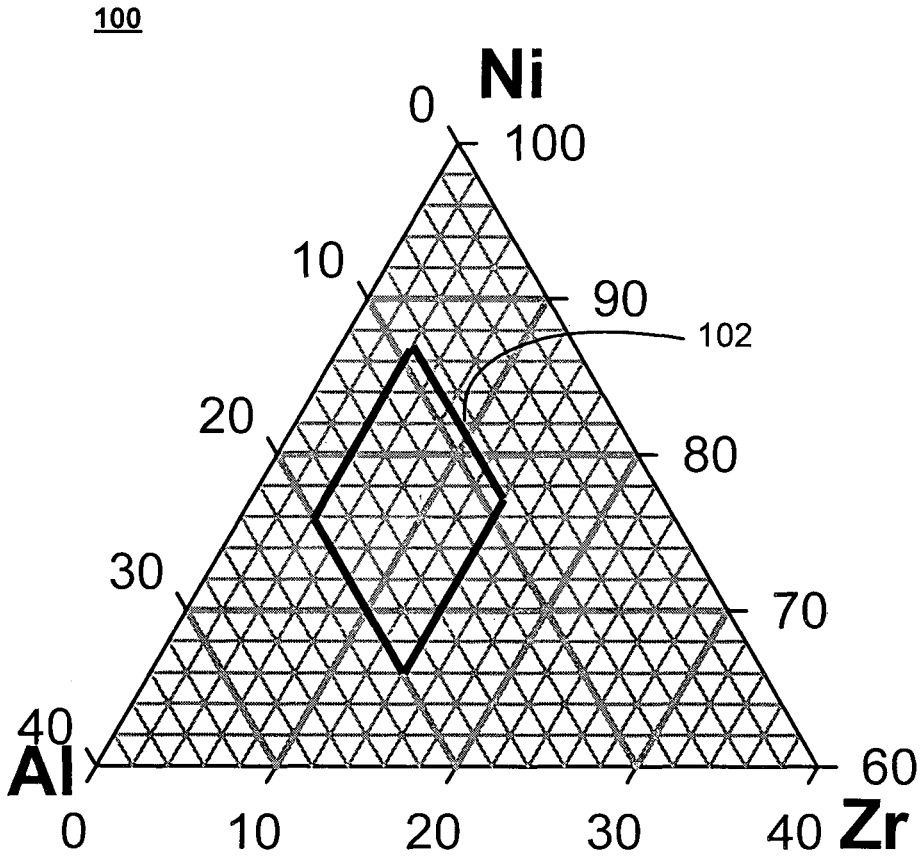
FIG. 1 illustrates a ternary section of a Ni—Al—Zr system showing a concentration range of elements therein, according to an embodiment of the present subject matter.

In one embodiment, the alloys in accordance with present subject matter have varying compositions of Nickel (Ni), Aluminum (Al), and Zirconium (Zr), primarily based on Ni. Such varying compositions of the alloys include Al and Zr, which are present in a concentration range of about 9 to 20%, and about 4 to 14%, respectively, the balance being Ni. The aforementioned composition range is described in FIG. 1 within a parallelogram 102 within a ternary section 100 of a Ni—Al—Zr system. These compositions are designated A to L and are shown in Table 1 along with their measured density. The Ni-rich side of a Ni—Zr based binary phase diagram shows a eutectic between Ni-based solid solution (γ) and a $Ni_5Zr$ phase, together with an intermediate phase $Ni_7Zr_2$. The Ni5Zr phase forms from a peritectic reaction $L+Ni_7Zr_2 \rightarrow Ni_5Zr$. The Ni-rich side of a Ni—Al based binary phase diagram shows that a $Ni_3Al$ (γ') phase forms from a peritectic reaction between a NiAl (β) and the γ' phase in one form of the binary phase diagram. In addition, a eutectic reaction exists between L and the γ' phase and β phase in another form. The NiAl (β) phase forms as an intermediate intermetallic phase. These intermetallics in the binary system may serve as the basis for the formation of fine-scale eutectic structures in the ternary system in the aforementioned concentration range through their interaction with each other.

TABLE 1

| Alloy | at % Al | at % Zr | at % Ni | Wt % Al | Wt % Zr | Wt % Ni | Density ($gm/cm^3$)±0.001 |
|---|---|---|---|---|---|---|---|
| Alloy A | 12 | 11 | 77 | 5.5 | 17.2 | 77.3 | 7.946 |
| Alloy B | 15 | 11 | 74 | 7.0 | 17.5 | 75.5 | 7.798 |
| Alloy C | 18 | 11 | 71 | 8.6 | 17.7 | 73.7 | 7.614 |
| Alloy D | 9 | 11 | 80 | 4.1 | 16.9 | 79.0 | 8.043 |
| Alloy E | 15 | 8 | 77 | 7.2 | 12.9 | 79.9 | 7.842 |
| Alloy F | 18 | 8 | 74 | 8.7 | 13.2 | 78.1 | 7.643 |
| Alloy G | 20 | 11 | 69 | 9.7 | 17.9 | 72.4 | 7.209 |
| Alloy H | 15 | 14 | 71 | 6.9 | 21.9 | 71.2 | 7.709 |
| Alloy I | 12 | 14 | 74 | 5.5 | 21.5 | 73.0 | 7.878 |
| Alloy J | 14 | 6 | 80 | 6.73 | 9.746 | 83.53 | 7.798 |
| Alloy K | 15 | 4 | 81 | 7.33 | 6.61 | 86.06 | 7.743 |
| Alloy L | 20 | 6 | 74 | 9.95 | 10.09 | 79.97 | 7.354 |

Further to the preparation, the alloys were melted in a laboratory scale non-consumable are melting unit and remelted several times to ensure homogeneity. A portion of the alloys was re-melted and suction cast into a cylindrical water-cooled copper (Cu) crucible. A combination of X-ray diffraction, electron probe microanalysis, and scanning electron microscopy in the back-scattered mode were used to analyze compositions and structures of various microstructural constituents. It is, however, understood that such alloys and their products may be manufactured by alternative methods known to those skilled in the art, such as wrought forms, or from consolidation of powder, or in equiaxed, directionally solidified or single crystal cast forms.

Figure 2A:
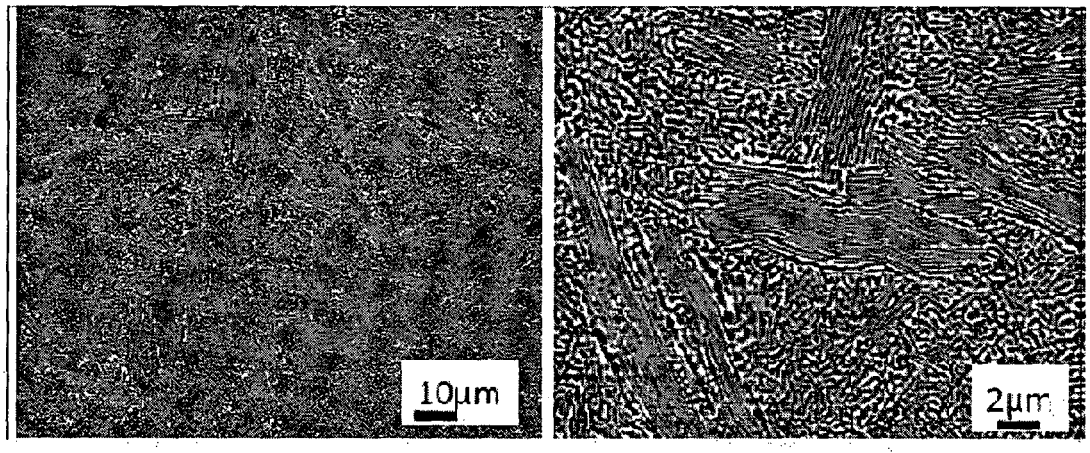
FIG. 2*a*, 2*b*, 2*c* depict microstructures of various Ni—Al—Zr based alloys, according to an embodiment of the present subject matter.
Figure 2B:
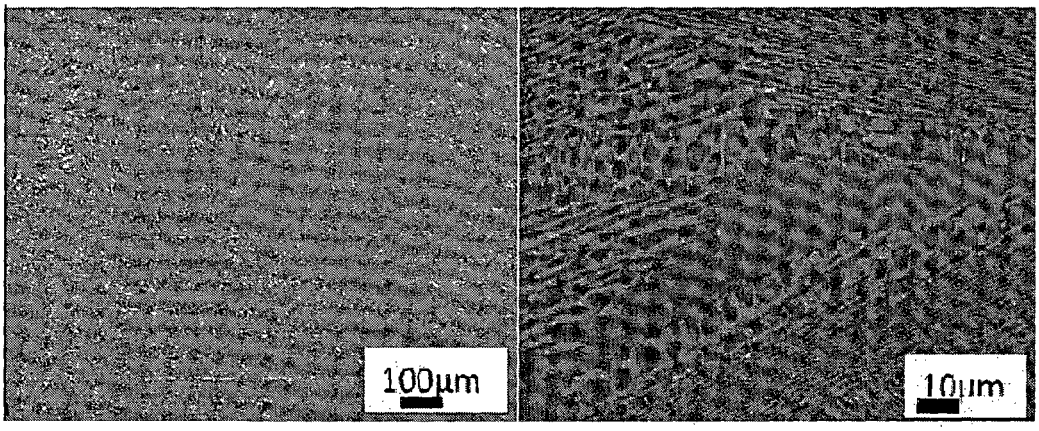
Figure 2C:
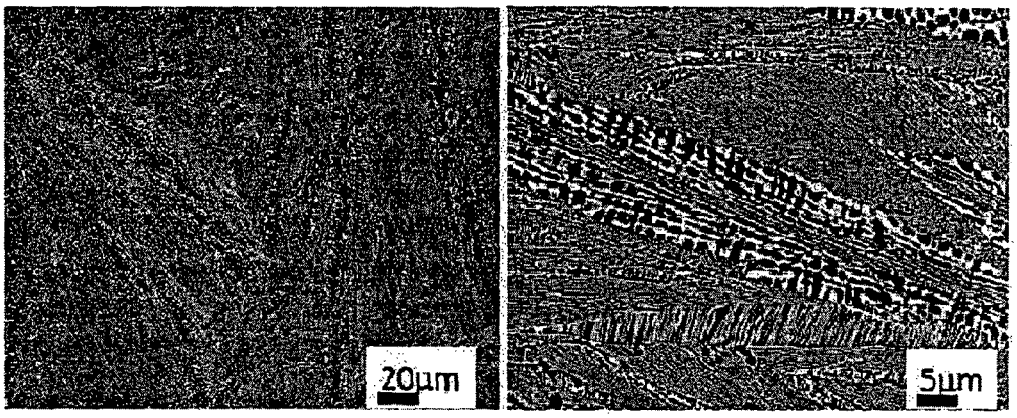

In another embodiment of the present subject matter, the alloy compositions include a combination of eutectic constituents further including the intermetallic phases $Ni_3Al$ denoted by γ', $Ni_5Zr$, $Ni_7Zr_2$ and NiAl denoted by β, in various proportions. FIG. 2 illustrates the different eutectic constituents of various alloys by way of microstructures 200 of various Ni—Al—Zr based alloys, according to an embodiment of the present subject matter. Alloy A, as depicted in FIG. 2*a* includes a eutectic constituent including the γ' and $Ni_5Zr$ phases. Alloy B, as depicted in FIG. 2*b*, includes a mixture of two eutectic constituents comprising respectively [γ'+$Ni_7Zr_2$] eutectic and a [β+$Ni_7Zr_2$] eutectic. The [γ'+$Ni_7Zr_2$] eutectic has a coarser structure, while the [β+$Ni_7Zr_2$] eutectic is extremely fine. Alloy C, as depicted in FIG. 2*c*, includes the same combination of eutectic structures, but with a larger volume fraction of the [β+$Ni_7Zr_2$] eutectic.

Figure 3A:
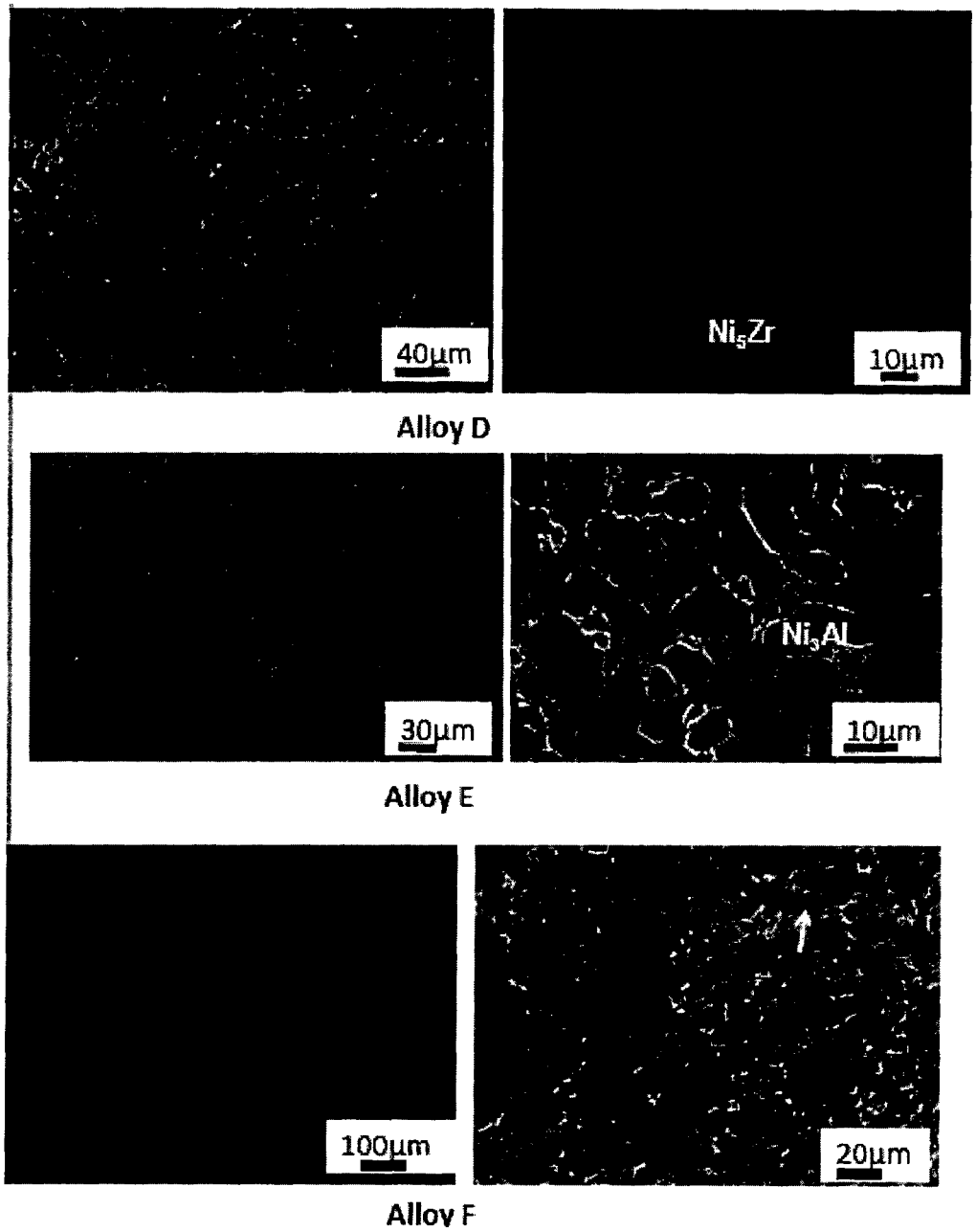
FIGS. 3*a*, 3*b*, and 3*c* depict microstructures of certain other alloys, denoted by alloys D till L, according to an embodiment of the present subject matter.
Figure 3B:
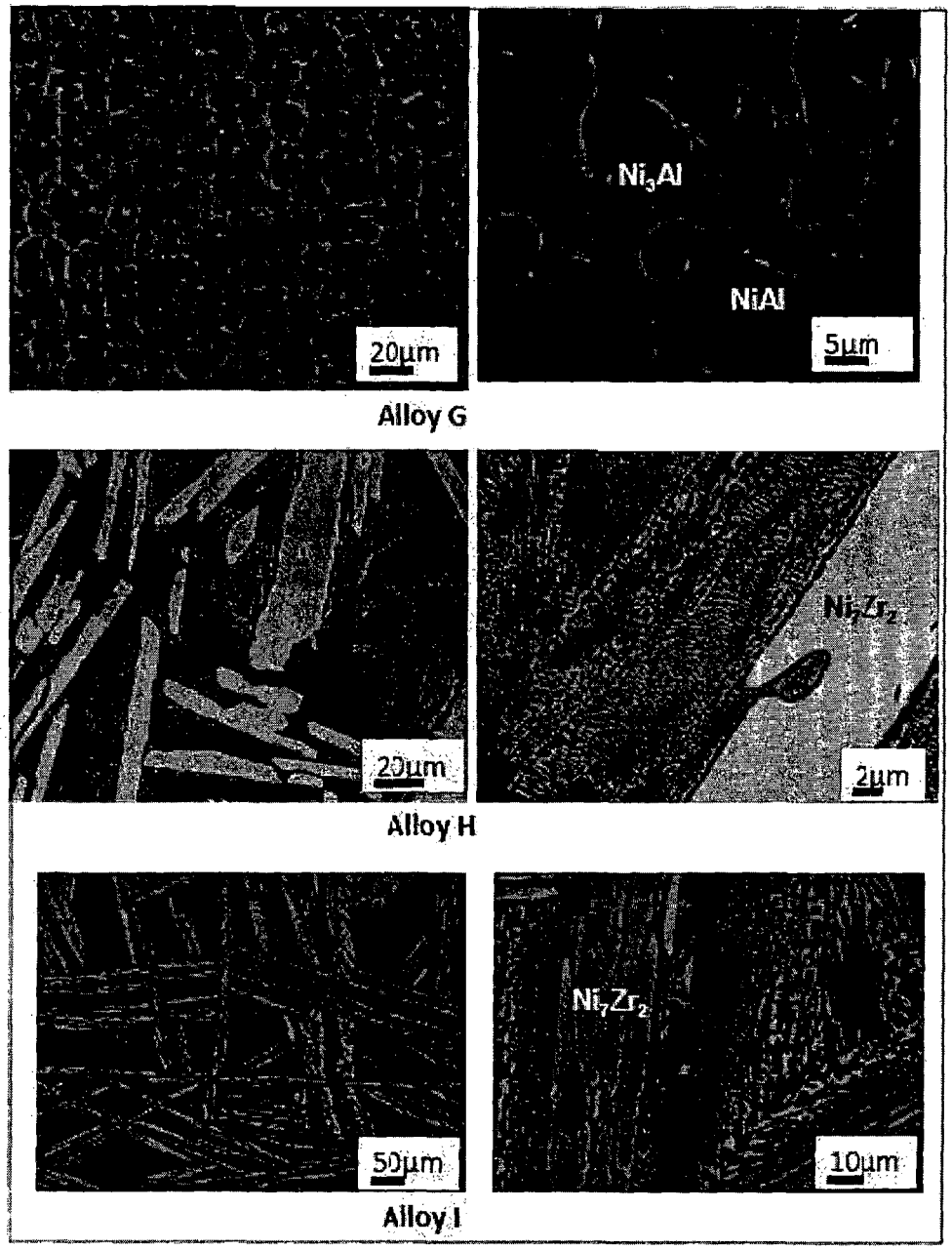
Figure 3C:
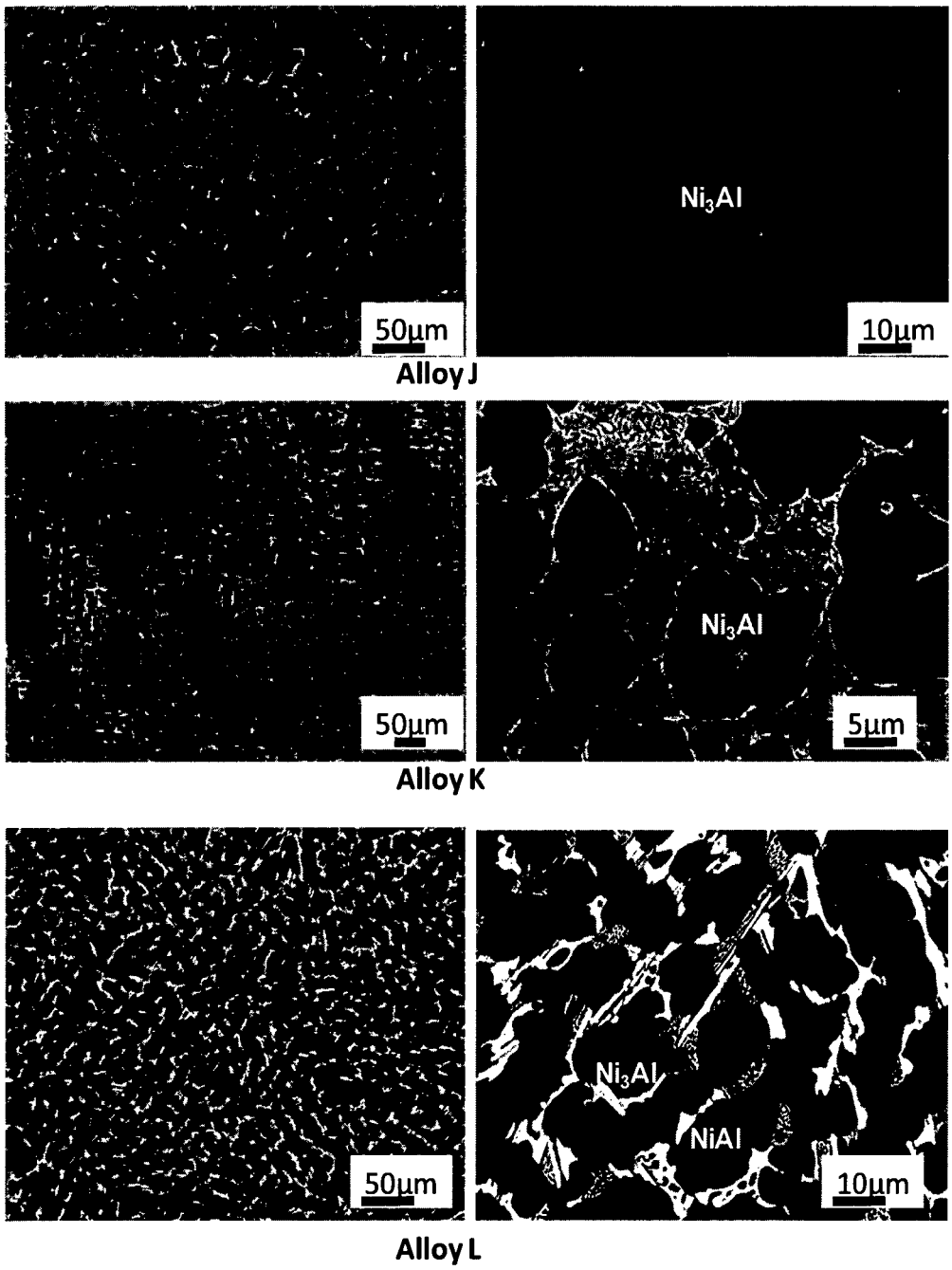

In another embodiment, FIG. 3 shows the microstructures 300 of a set of compositions that contains primary solidification phases in addition to the aforementioned eutectics. FIG. 3(*a-c*) depicts the microstructures 300 of Alloys D till L. The primary solidification phase is the first phase to form during solidification. Accordingly, as depicted in the FIG. 3*a*, Alloy D includes the primary solidification phase $Ni_5Zr$, in addition to the eutectic [$Ni_5Zr$+γ']. Alloy E includes γ' as the primary solidification phase which is surrounded by small amounts of $Ni_5Zr$ together with the [$Ni_5Zr$+γ'] eutectic. In Alloy F, $Ni_3Al$ (γ') is the primary solidification phase, together with $Ni_7Zr_2$ and the [β+$Ni_7Zr_2$] eutectic. As depicted in the FIG. 3*b*, Alloys H and I include $Ni_7Zr_2$ as the primary solidification phase in addition to the eutectics [$Ni_5Zr$+γ'] and [$Ni_7Zr_2$+γ']. Alloy G has β and γ' as the primary solidification phases with the [β+$Ni_7Zr_2$] eutectic. FIG. 3*c* depicts the microstructures 300 of Alloys J till L. Like Alloy E, alloys J and K also show γ' as the primary solidification phase, surrounded by small amounts of $Ni_5Zr$ together with the [$Ni_5Zr$+γ'] eutectic. The eutectic volume fraction decreases from Alloy E to Alloy K. In Alloy L, β acts the primary solidification phase and is surrounded by γ' together with $Ni_7Zr_2$ and the [β+$Ni_7Zr_2$] eutectic.

Figure 4A:
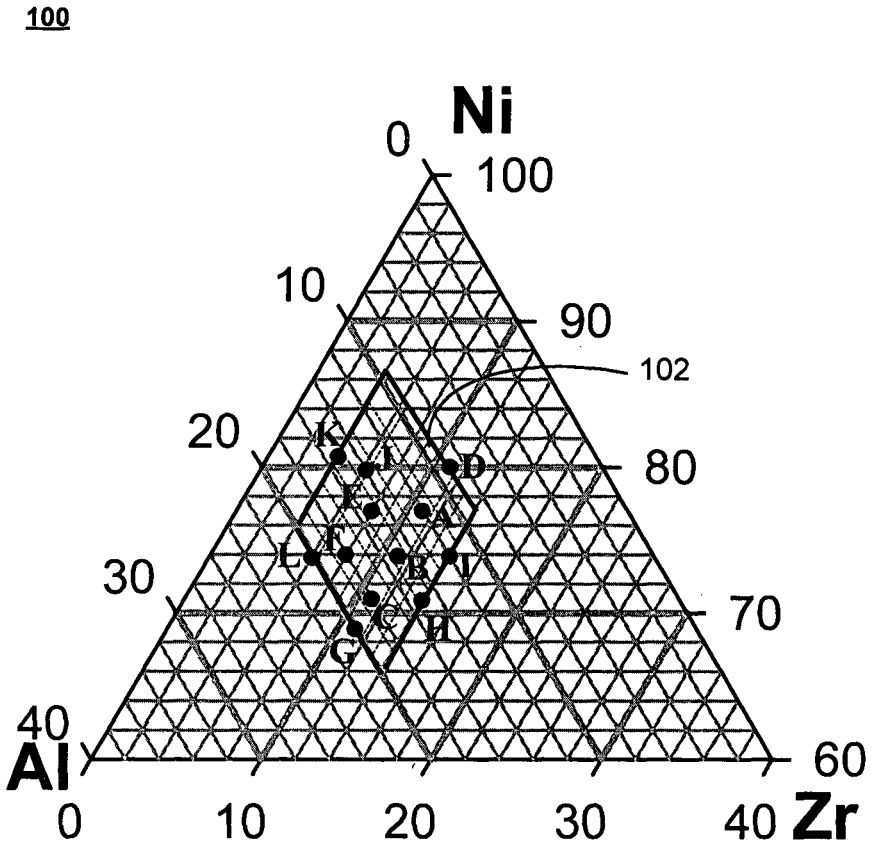
FIG. 4*a* illustrates stress-strain curves of alloys A till L in compression, measured at room temperature, according to an embodiment of this present subject matter.
Figure 4B:
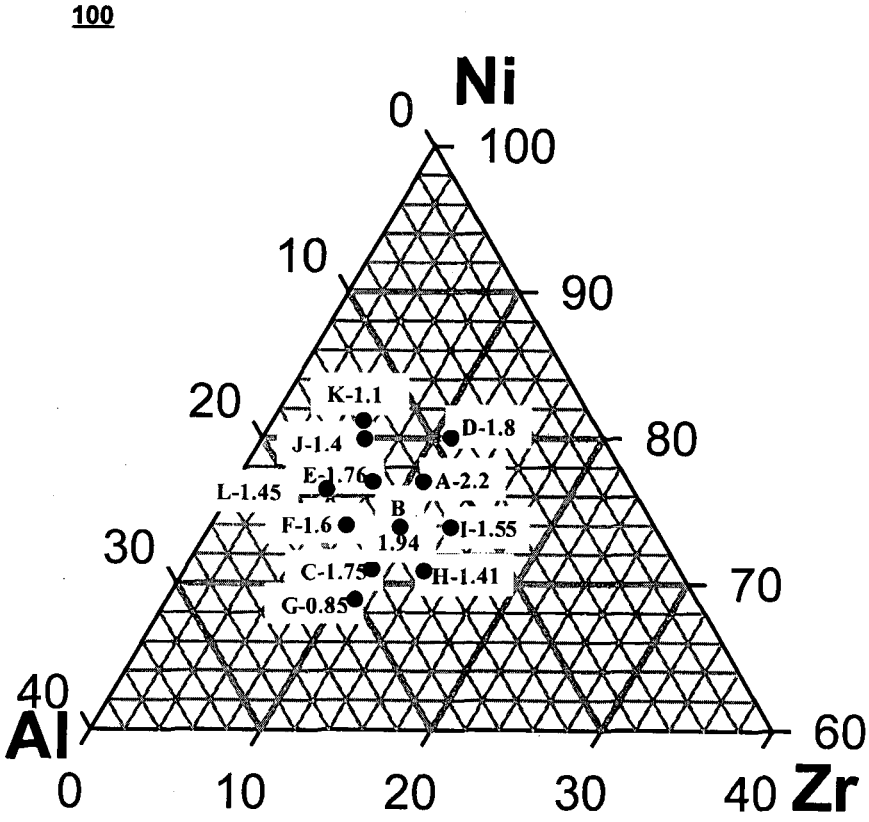
FIG. 4*b* illustrates the values of compressive yield strength at room temperature of the alloys A till L shown in FIG. 4*a*, according to an embodiment of the present subject matter.

Further, in another embodiment, alloys including the eutectic structures as well as the alloys including primary solidification phases in addition to the eutectic structures have been tested in compression, at room temperature and at 700° C. Samples for compression testing were derived from the suction cast samples following American Society for testing and materials (ASTM) standards. FIG. 4*a* shows stress-strain curves in compression for Alloys A to L. The measured values of yield strength at room temperature derived from these curves for Alloys A to L are shown in FIG. 4*b*. In addition, these values have been depicted therein in accordance with the alloy compositions shown in the ternary Ni—Al—Zr section 100. Alloys A, B, and C, which are solely composed of the eutectic constituents, show the highest yield strength. These alloys respectively show yield strengths of 2.2, 1.94, and 1.75 GPa. Alloys D, E, F, G, H, I, J, K and L respectively show the yield strength of 1.8, 1.76, 1.6, 0.85, 1.41, 1.55, 1.4, 1.1, and 1.45 GPa. It may be understood that the presence of the primary phase in Alloys D-L results in a decrease of the yield strength.

Figure 5:
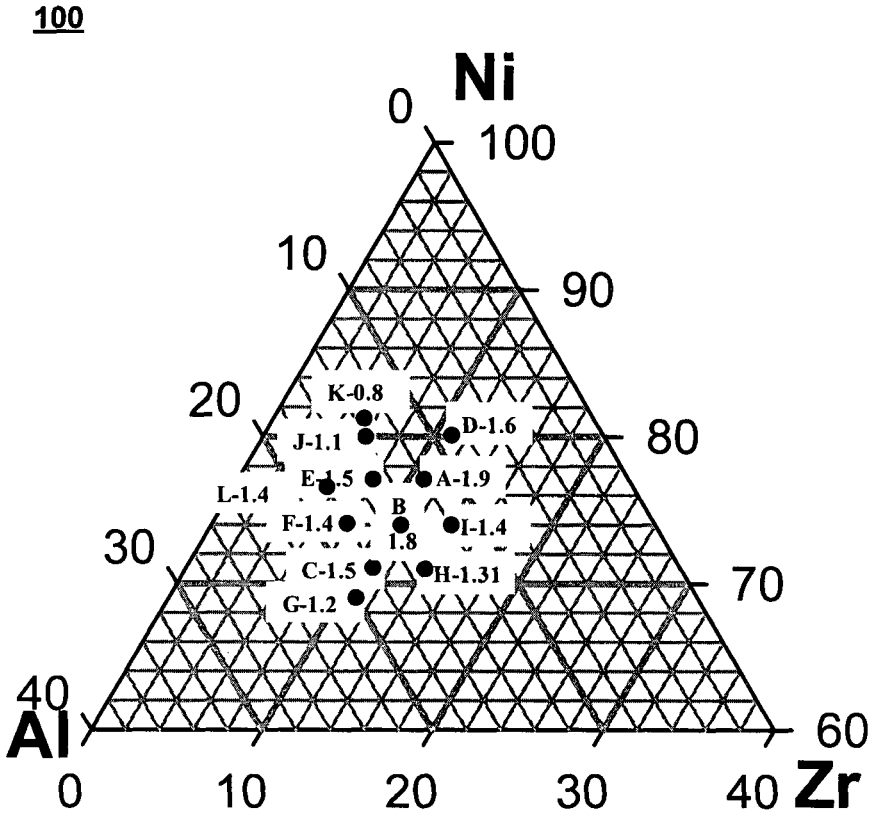
FIG. 5 illustrates values of the compressive yield strength of the alloys from A till L at 700° C., according to an embodiment of the present subject matter.

FIG. 5 illustrates the measured values of the yield strength of the alloys from A till L tested at about 700° C., depicted according to the alloy compositions shown in the ternary section 100 of the Ni—Al—Zr section. As depicted in the FIG. 5, the alloys from A till L, respectively, show the yield strength of 1.9, 1.8, 1.5, 1.6, 1.5, 1.4, 1.2, 1.31, 1.4, 1.1, 0.8, and 1.4 GPa at 700° C. It may be understood that the presence of the primary phase in Alloys D-L results in a decrease of the yield strength at 700° C. It may also be understood from the tests conducted for Alloy B at 800° C. and 900° C., as an example, that the alloys of the present subject matter retain their strength till about 700° C.

Figure 6:
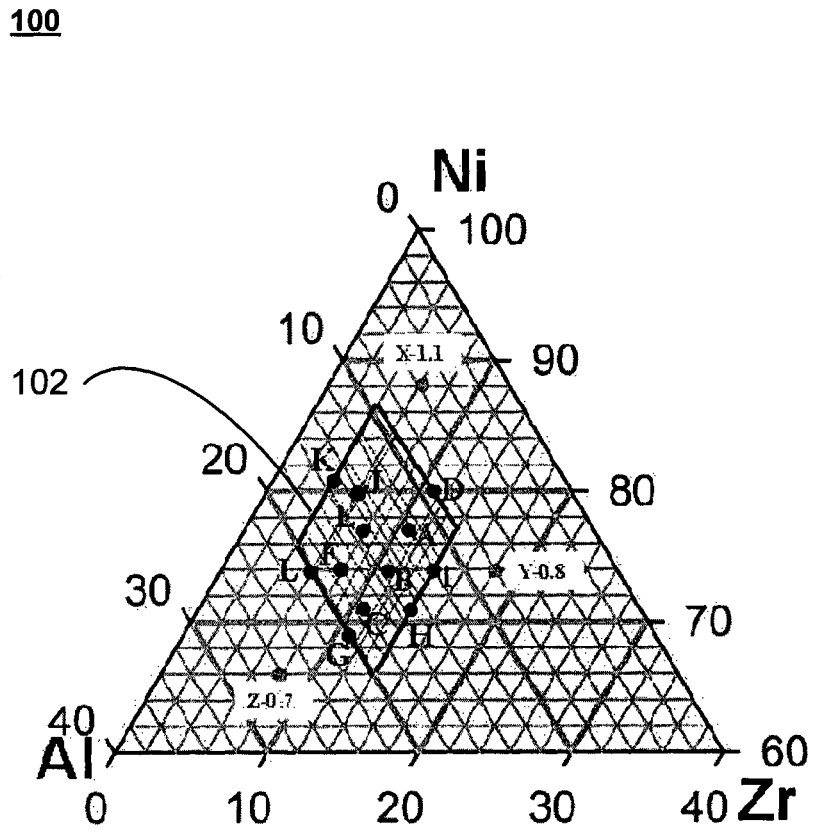
FIG. 6 depicts the compressive yield strength of alloys X, Y and Z at room temperature.

In order to illustrate relevant compositions from which substantially high strengths that can realized, FIG. 6 comparatively depicts the yield strength in GPa at room temperature of Alloys X, Y and Z, corresponding to the compositions marked as X, Y and Z, as well as the yield strength of Alloys A to L. Alloy X contains includes Ni-based solid solution, along with a [Ni+$Ni_5Zr$] eutectic structure. The yield strength of Alloy X is high at room temperature but has very low yield strength of 0.3 GPa at 700° C. Alloy Y shows a large amount of a primary phase $Ni_7Zr_2$ and has low yield strength at room temperature and a yield strength of 0.75 GPa at 700° C. Alloy Z includes a substantially large amount of the primary phase β (NiAl) and also shows comparatively lower yield strength at room temperature and at 700° C. (0.54 GPa).

Figure 7:
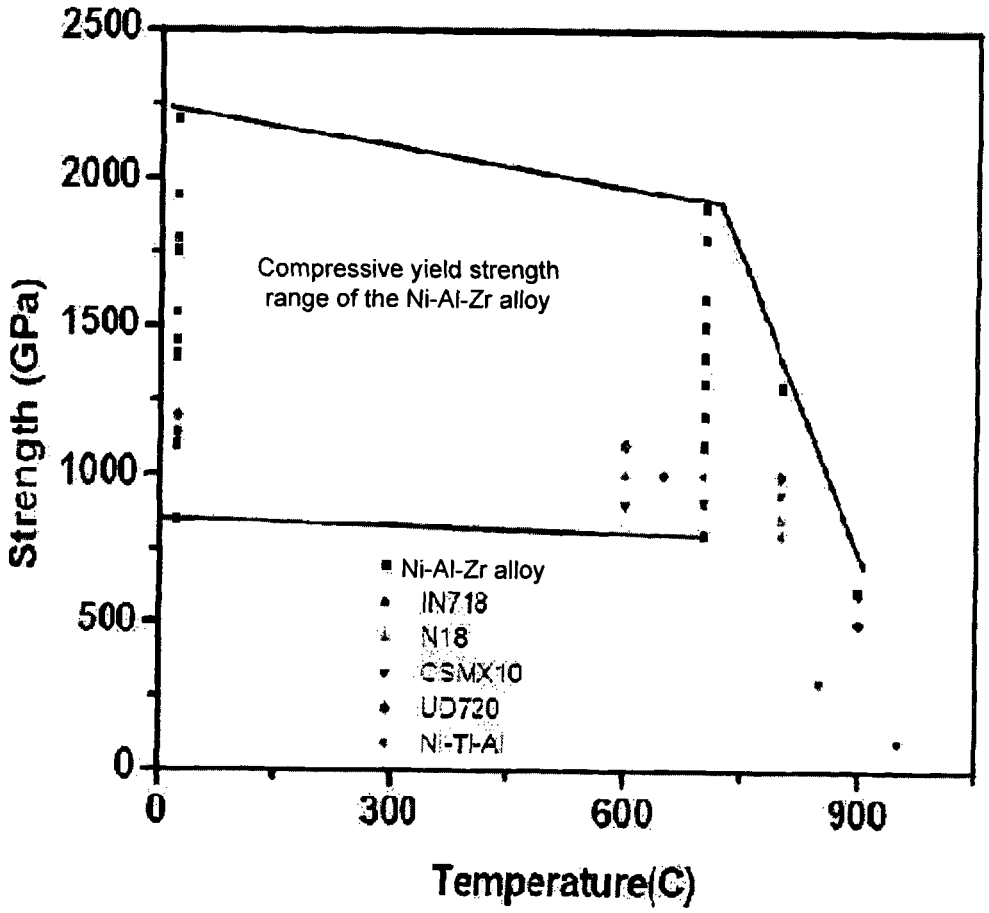
FIG. 7 illustrates a plot depicting comparison of compressive yield strength at different temperatures between Ni—Al—Zr alloys of the present subject matter and conventional Ni based alloys, according to an embodiment of the present subject matter.

FIG. 7 illustrates a plot 700 depicting comparison of the yield strength of the alloys of the present subject matter with the conventional Ni based alloys known in the art. It is observed that the alloys of the present subject matter provide a range of substantially high yield strengths, thereby being improved in comparison to the conventional alloys. It may also be understood from the tests conducted for Alloy B at 800° C. and 900° C., that the alloys of the present subject matter retain their strength to 700° C.

Figure 8:
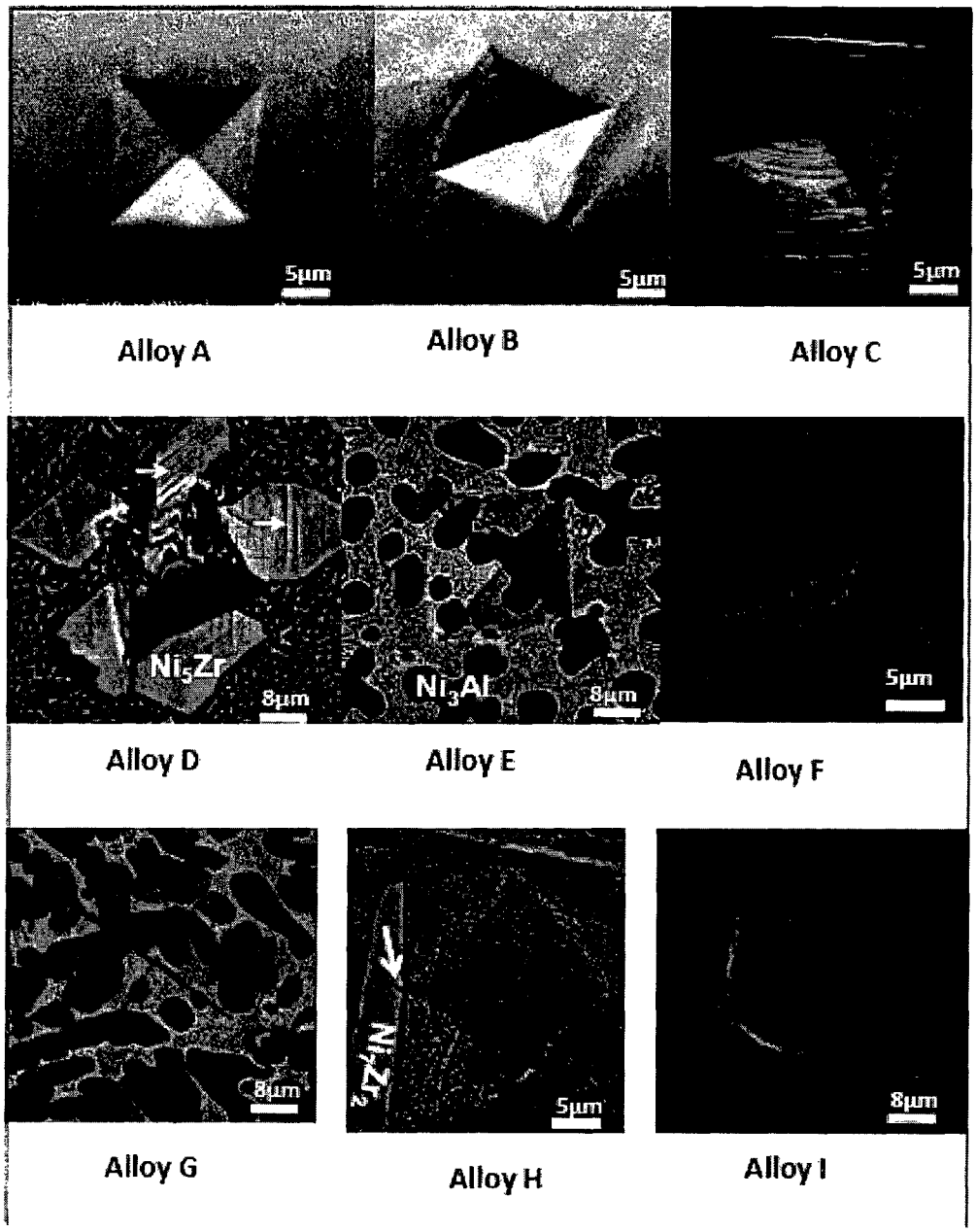
FIG. 8 illustrates a micrograph of indents performed using a Vickers indentor for alloys A to I.

Further, the resistance to fracture, of various primary solidification phases and eutectic constituents as present within Alloys A to I, is probed by examining the corners of hardness indents made at various regions of the microstructure of Alloys A to I with a Vickers indent at a load of 200 gm. FIG. 8 illustrates a micrograph 800 of such indents. As can be observed from the microstructures in FIG. 8, the primary solidification phase $Ni_7Zr_2$ as present in Alloys D to I develops cracks at the corners of the hardness indents. However, the eutectic structures as present within Alloys A and B, both of which include the $Ni_7Zr_2$ phase do not undergo cracking. It may be gathered that the presence of the aforementioned intermetallics in a fine scale in the eutectic constituents provides additional plasticity to these high strength alloys.

Figure 9:
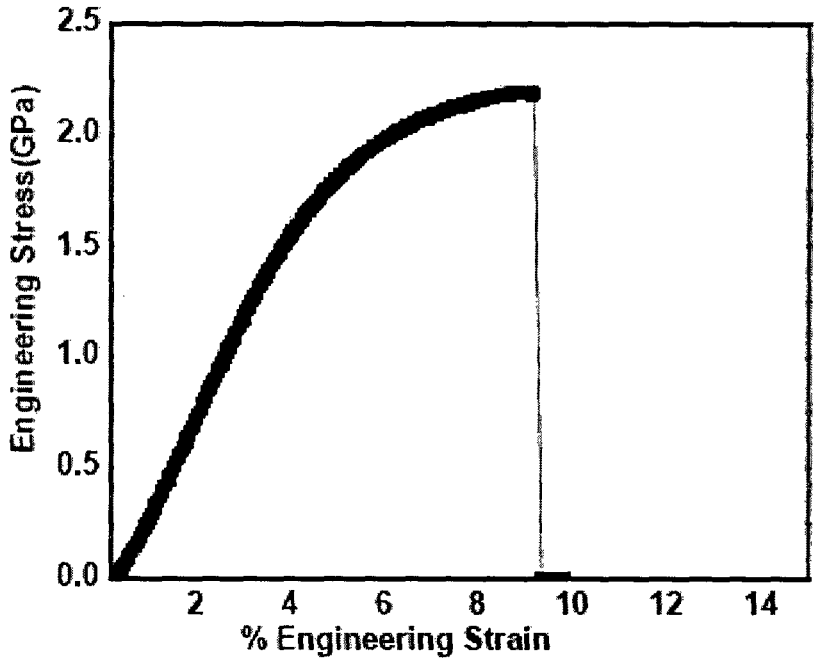
FIG. 9 illustrates a tensile stress strain curve for alloy B at room temperature, according to an embodiment of the present subject matter.

As known in the art, heavy duty applications of structural materials require a reasonable tensile ductility present within the structural materials. FIG. 9 illustrates tensile stress strain curves 900 for Alloy B room temperature as an example. In case of Alloy B, a tensile ductility of 3-4% has been achieved.

As a part of another embodiment of the present subject matter, a number of experiments have been conducted upon Alloy B to determine various properties thereof in order to investigate the high temperature stability of the alloys of the present subject matter. However, the present subject matter is not restricted by the results of the below-mentioned experiments, which may be extended to cover experiments conducted over Alloys A, C, D, E, F, G, H, I, J, K, and L. The high temperature stability of the alloys has been investigated by exposure of Alloy B to high temperature for varying amounts of time followed by an examination of the microstructure.

Figure 10:
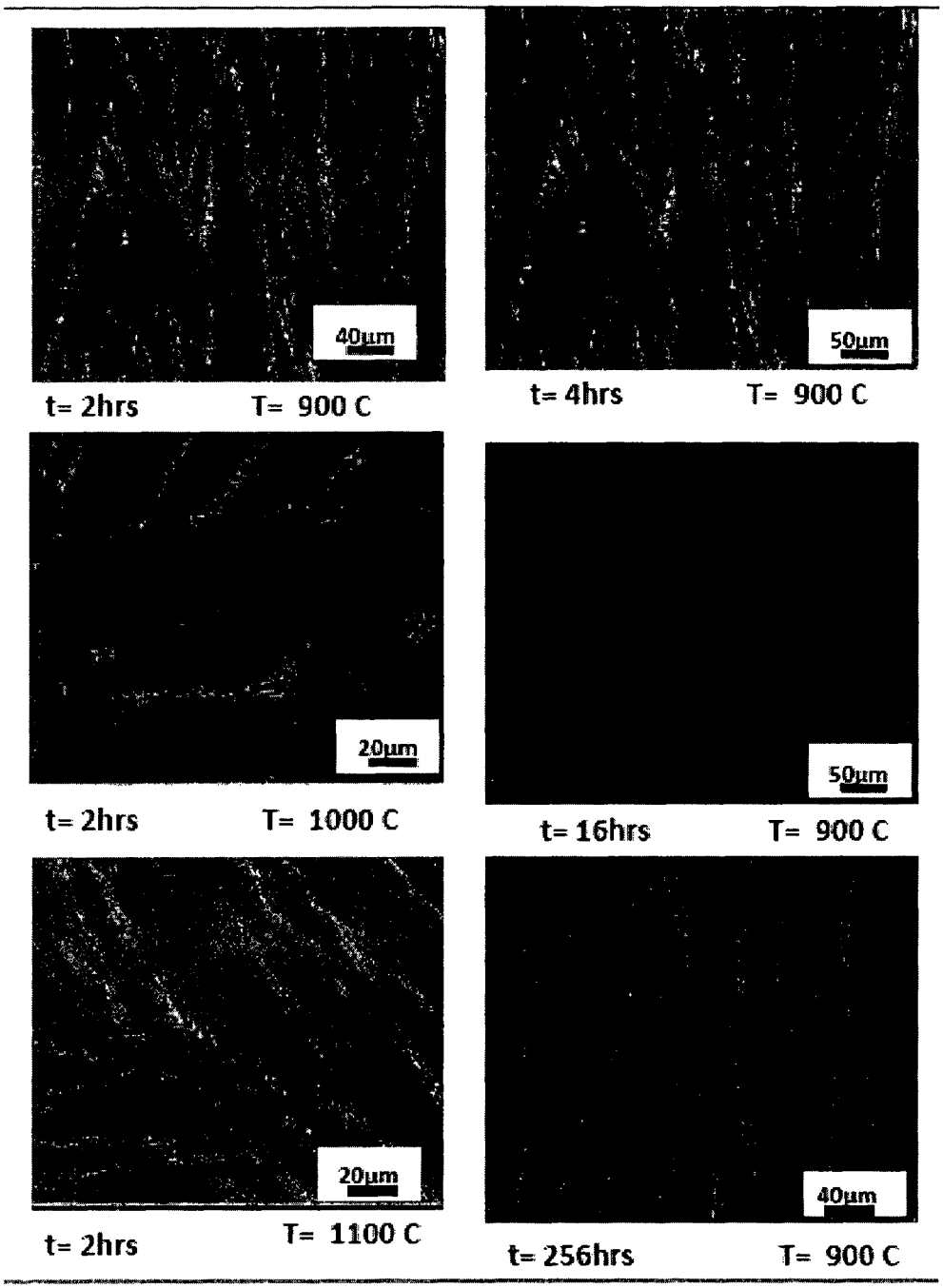
FIG. 10 illustrates micrographs depicting the stability of the microstructures of alloy B at different temperatures, according to an embodiment of the present subject matter.

FIG. 10 illustrates micrographs 1000 depicting the stability of the microstructures of Alloy B at different temperatures for 2 hours and for different time durations at 900° C. It can be gathered from the micrographs that very high temperature exposure, of Alloy B, for extended lengths of time has no effect on the micro structural condition. Further, it can be observed from the micrographs 1000 that Alloy B shows stable microstructure upto 1100° C. with no change in length scale.

Also as a part of the high temperature stability, weight gain of Alloy B was determined after exposure to air at different temperature both under static and cyclic oxidation conditions. Such studies were carried out in a thermo gravimetric analyzer. Samples were heated at rate of 20° C./min and held for different times and temperatures for the static study. In the case of cyclic tests samples, each cycle consisted of heating to a particular temperature at a rate of 20° C./min and cooling at same rate down to 300° C.

Figure 11A:
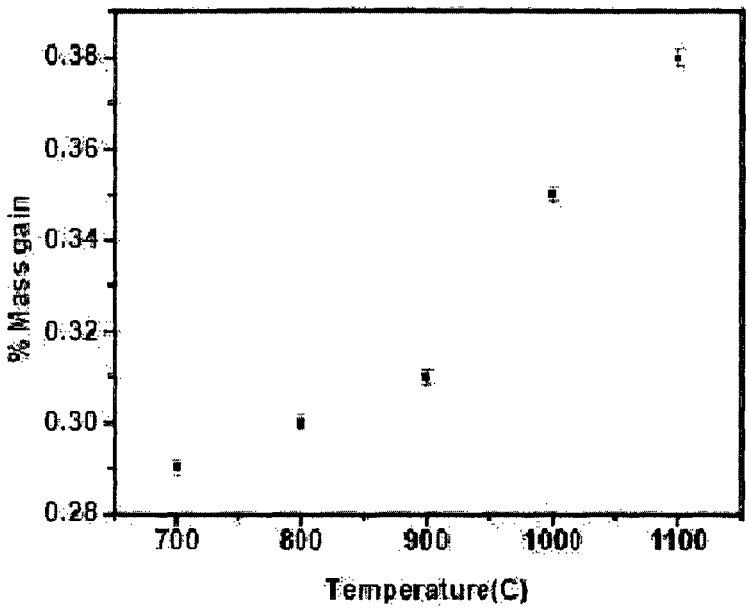
FIG. 11*a* illustrates a graph depicting comparison of percentage mass gain suffered by alloy B after exposure at different temperatures, according to an embodiment of the present subject matter.
Figure 11B:
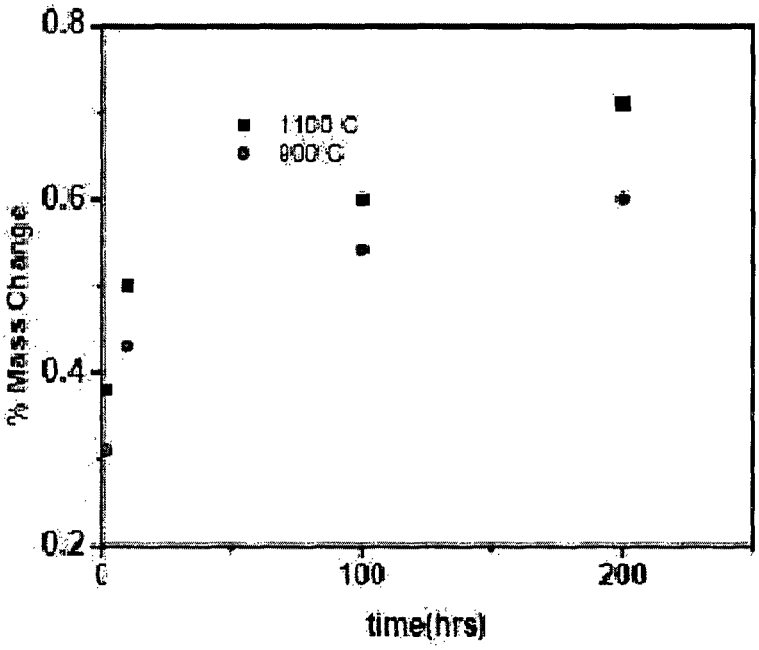
FIG. 11*b* illustrates a graph depicting comparison of percentage mass changes suffered by alloy B after exposure at 900° C. and 1100° C., according to an embodiment of the present subject matter.
Figure 12A:
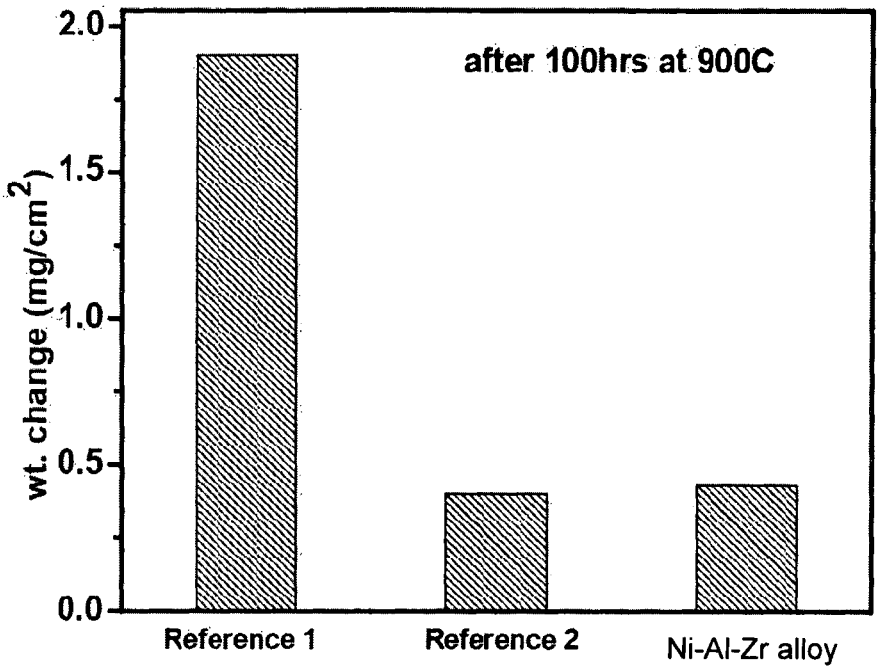
FIG. 12*a* illustrates a graph depicting comparison of weight changes suffered by alloy B in comparison with conventional alloys within the same range of temperatures, when subjected to a static oxidation, according to an embodiment of the present subject matter
Figure 12B:
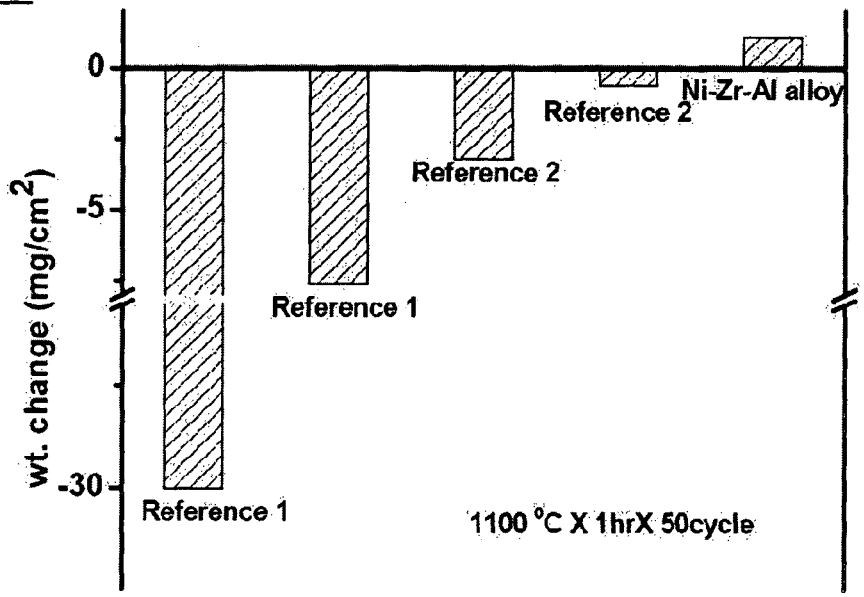
FIG. 12*b* illustrates a graph depicting comparison of weight changes suffered by alloy B in comparison with conventional alloys within the same range of temperatures, when subjected to a cyclic oxidation, according to an embodiment of the present subject matter.

FIG. 11 illustrates graphs 1100 and 1110 depicting comparison of percentage mass gain and percentage mass change suffered by Alloy B at various temperatures for different durations, respectively. FIG. 11*a* shows a comparison of percentage mass gain suffered by Alloy B due to oxidation after exposure at various temperatures for 2 hours. FIG. 11*b* shows a comparison of the percentage mass change suffered by Alloy B after exposure for long durations at 900° C. and 1100° C., for 2, 4, 16, and 256 hours. As understood from FIG. 11*a* and FIG. 11*b*, the mass gain and mass change suffered by Alloy B is substantially less. Further, FIG. 12*a* and FIG. 12*b* illustrate graphs 1200 and 1210 depicting comparison of weight change suffered by Alloy B and weight change suffered by conventional alloys (as depicted by Reference 1 and Reference 2 in US Patent 2010/0143182A1 and US Patent 2008/0008618A1) and within the same range of temperatures, in both static and cyclic oxidation tests, respectively. As understood from the FIG. 12*a* and FIG. 12*b*, the weight change suffered by Alloy B is substantially less as compared to the conventional alloys, when subjected to static and cyclic oxidation.

In yet another embodiment of the present subject matter, the alloys listed in Table 1 may include limited alloying additives or trace additives. These additives also retain the eutectic constituents within the alloys of the present subject matter. The effect of limited alloying additions or the presence of trace additions in improving the properties of the alloys listed in Table 1 is considered by way of examples. The addition of such additives does not substantively affect the nature of the intermetallic phases, their derivatives, their combinations and their distribution as illustrated in FIGS. 2 and 3. Such alloying additions may replace Zr, Ni, or Al in the compositions of the Table 1. For example, additions which may be expected to replace Zr without affecting the formation of the $Ni_5Zr$ and $Ni_7Zr_2$ phase are Hafnium (Hf) and Scandium (Sc). Additions which may substitute for Ni are Cobalt (Co), Platinum (Pt), Palladium (Pd), Chromium (Cr), Ruthenium (Ru), and Rhenium (Re). Additions, such as Tantalum (Ta) and Titanium (Ti) may be expected to substitute for Al in the γ' or β phase.

Similarly, additions of Niobium (Nb), Molybdenum (Mo), and Tungsten (W) may be used to suitably alter the properties of the aforementioned intermetallic compounds. Further, Boron (B) may be added to affect grain boundary strength in materials of this class.

Table 2 illustrates the additional alloying elements that may be added to alter properties of described Ni-based alloys.

TABLE 2

| Alloy | Mo, W, Nb | Ti, Ta | Hf, Sc | Co, Pt, Pd | Cr, Re, Ru | B |
|---|---|---|---|---|---|---|
| A-L | 0.0-5 at % | 0.0-5 at % | 0.0-5 at % | 0.0-5 at % | 0.0-5 at % | 0.0-0.1 wt % |

Table 3 illustrates the compressive yield strength properties of some alloys with such additional alloying elements, as an example. Such alloying additions are to be understood as examples with respect to the microstructure and various intermetallic phases and their

TABLE 3

| Alloy (at %) | Compressive Yield Strength (GPa) at Room Temperature | Compressive Yield Strength (GPa) at 700° C. |
|---|---|---|
| Ni—5Co—15Al—10.9Zr | 2.1 | 2 |
| Ni—5Ti—15Al—5.9Zr | 1.85 | 1.8 |
| Ni—5Cr—15Al—10.9Zr | 2.0 | 1.9 |

derivatives that correspond to embodiments of this present subject matter.

We claim:

1. A Nickel-Aluminum-Zirconium alloy comprising a plurality of intermetallic phases, wherein a composition of Aluminum (Al) and Zirconium (Zr) within the Nickel-Aluminum-Zirconium alloy is in a range of about 13.5 to about 19, about 4 to about 14 by atomic percentages, respectively, with the balance being Nickel;

wherein the plurality of intermetallic phases is selected from the group consisting of at least two of $Ni_3Al$, NiAl, $Ni_5Zr$, $Ni_7Zr_2$ and a combination of structural derivatives of the corresponding intermetallic phases;

wherein the Nickel-Aluminum-Zirconium alloy includes at least one eutectic composition comprising eutectic constituents $Ni_3Al+Ni_5Zr$, $Ni_3Al+Ni_7Zr_2$, $NiAl+Ni_7Zr_2$, or combinations thereof.

2. The Nickel-Aluminum-Zirconium alloy as claimed in claim 1 wherein the Nickel-Aluminum-Zirconium alloy is characterized by a yield strength of at least 0.8 Giga Pascal (GPa) at room temperature and a yield strength of at least 0.8 GPa at 700° C.

3. The Nickel-Aluminum-Zirconium alloy as claimed in claim 1, further comprising at least one primary solidification phase, wherein the at least one primary solidification phase is one of $Ni_3Al$, $Ni_5Zr$, Ni $Zr_2$ and NiAl.

4. The Nickel-Aluminum-Zirconium alloy as claimed in claim 3, further comprising at least one additive, wherein at least one additive is one of an alloying additive and a trace additive.

5. The Nickel-Aluminum-Zirconium alloy as claimed in claim 3 wherein the Nickel-Aluminum-Zirconium alloy is characterized by a yield strength of at least 0.8 Giga Pascal (GPa) at room temperature and a yield strength of at least 0.8 GPa at 700° C.

6. The Nickel-Aluminum-Zirconium alloy as claimed in claim 1, further comprising at least one additive, wherein at least one additive is one of an alloying additive and a trace additive.

7. The Nickel-Aluminum-Zirconium alloy as claimed in claim 6 wherein the Nickel-Aluminum-Zirconium alloy is characterized by a yield strength of at least 0.8 Giga Pascal (GPa) at room temperature and a yield strength of at least 0.8 GPa at 700° C.

8. The Nickel-Aluminum-Zirconium alloy as claimed in claim 6, wherein the at least one additive is selected from the group consisting of Hafnium (Hi), Scandium (Sc), Cobalt (Co), Platinum (Pb), Palladium (Pd), Chromium (Cr), Ruthenium (Ru), Rhenium (Re), Tantalum (Ta), Titanium (Ti), Niobium (Nb), Molybdenum (Mo), and Tungsten (W).

9. The Nickel-Aluminum-Zirconium alloy as claimed in claim 8 wherein the Nickel-Aluminum-Zirconium alloy is characterized by a yield strength of at least 0.8 Giga Pascal (GPa) at room temperature and a yield strength of at least 0.8 GPa at 700° C.

10. The Nickel-Aluminum-Zirconium alloy as claimed in claim 8, wherein the at least one additive retains eutectic constituents within the Nickel-Aluminum-Zirconium alloy.

11. The Nickel-Aluminum-Zirconium alloy as claimed in claim 10 wherein the Nickel-Aluminum-Zirconium alloy is characterized by a yield strength of at least 0.8 Giga Pascal (GPa) at room temperature and a yield strength of at least 0.8 GPa at 700° C.

12. The Nickel-Aluminum-Zirconium alloy as claimed in claim 10 wherein the Nickel-Aluminum-Zirconium alloy is characterized by a yield strength of at least 0.8 Giga Pascal (GPa) at room temperature and a yield strength of at least 0.8 GPa at 700° C.

* * * * *